US005318192A

United States Patent [19]

Rebeyrolle et al.

[11] Patent Number: 5,318,192

[45] Date of Patent: Jun. 7, 1994

[54] ASSEMBLY COMPRISING A SCREW CLOSURE CAP OF PLASTIC MATERIAL WITH A GUARANTEE STRIP AND A RECEPTACLE, AND THE CORRESPONDING CAP

[75] Inventors: Michel Rebeyrolle; Bernard Schneider, both of Sainte Menehould, France

[73] Assignee: CEBAL, France

[21] Appl. No.: 735,252

[22] Filed: Jul. 24, 1991

[30] Foreign Application Priority Data

Jul. 27, 1990 [FR] France ..... 90 10002

[51] Int. Cl.[5] ..... B65D 41/34

[52] U.S. Cl. ..... 215/252; 215/256

[58] Field of Search ..... 215/252, 253, 254, 256

[56] References Cited

U.S. PATENT DOCUMENTS

| | | | |
|---|---|---|---|
| 4,062,466 | 12/1977 | Conti | 215/252 |
| 4,305,516 | 12/1981 | Perne et al. | 215/252 |
| 4,448,318 | 5/1984 | Lowe | 215/252 |
| 4,548,329 | 10/1985 | Curry | 215/252 X |
| 4,609,115 | 9/1986 | Moore et al. | 215/252 |
| 4,848,613 | 7/1989 | Nofer | 215/252 |
| 5,040,692 | 8/1991 | Julian | 215/252 |
| 5,056,675 | 10/1991 | Julian | 215/252 |
| 5,115,932 | 5/1992 | Schneider | 215/252 |

FOREIGN PATENT DOCUMENTS

| | | | |
|---|---|---|---|
| 0008190 | 2/1990 | European Pat. Off. | 215/252 |

*Primary Examiner*—Allan N. Shoap
*Assistant Examiner*—Chris McDonald
*Attorney, Agent, or Firm*—Pollock, Vande Sande & Priddy

[57] ABSTRACT

The cap (1) portion of the assembly comprises at least one guarantee strip (2, 3) connected to its body (5) by breakage bridges (4), the neck of the receptacle carrying ratchet teeth and the guarantee strip (2, 3) carrying internal teeth (6) adapted to cooperate with the ratchet teeth. The ratchet teeth (9) are elastically inclinable in the direction of screwing to allow the cap (1) to be screwed on while preventing its being unscrewed without breaking the bridges (4). At least one guarantee strip (2) has free ends (21) and is ejected transversely the first time the cap (1) is screwed on. The internal teeth (6) are so disposed that they cooperate with the ratchet teeth by only a single internal tooth (6) upon screwing and unscrewing. The cap (1) can be applied to tamper-proof receptacles in the cosmetic, pharmaceutical, hygiene, food and cleaning product industries.

12 Claims, 2 Drawing Sheets

ASSEMBLY COMPRISING A SCREW CLOSURE CAP OF PLASTIC MATERIAL WITH A GUARANTEE STRIP AND A RECEPTACLE, AND THE CORRESPONDING CAP

FIELD OF THE INVENTION

The invention relates to a closure cap of plastic material with a detachable guarantee strip, and its combination with an associated receptacle.

BACKGROUND OF THE INVENTION

U.S. Pat. No. 315,403 describes a screw closure cap of plastic material associated with a receptacle, the cap comprising a circular guarantee ring connected to the body of the capsule by breakable bridges. The neck of the receptacle carries profiled faces or "ratchet teeth", and the guarantee strip carries internal teeth co-operating with the ratchet teeth, latter being elastically inclinable in the direction of screwing in order to allow the cap to be screwed on without breaking the breakable but then preventing its being unscrewed without these bridges being broken, the ratchet teeth then being elastically straightened.

SUMMARY OF THE INVENTION

The invention is intended to render more apparent the open it by rupturing the breakable bridges being reduced.

The invention has as its object the assembly of a screw closure cap of plastic material and a receptacle, the cap comprising at least one guarantee strip connected to its body by breakable bridges and being intended for closing the receptacle, the neck of which carries ratchet teeth, the guarantee strip itself carrying internal teeth cooperating with these ratchet teeth, which are elastically inclinable in the direction of screwing in order to allow the cap to be screwed on, its unscrewing without breakage of one or more of the said bridges being then prevented.

According to the invention:

(a) at least one aforesaid guarantee strip has its two ends free, and the strip is ejected transversely the first time the cap is unscrewed;

(b) the internal teeth of the guarantee strip are disposed in such a way as to co-operate with the ratchet teeth only through a single internal tooth upon screwing on and unscrewing.

The cap may have a single skirt, or it may have a double skirt which carries the guarantee strip or strips.

In such an assembly, in which a circular guarantee strip is divided into two distinct strips of equal length, breakage of the breakable bridges of these strips by unscrewing the cap results in elastic opening of each strip and its sudden transverse movement away from the neck of the receptacle as soon as the bridges have broken. This can be applied to a short guarantee strip, for example one which is connected to the body of the cap by two breakable bridges, as well as to a strip having a peripheral extension exceeding 180° and capable of extending beyond 220° so long as its geometry allows it to be freely detached from the neck of the receptacle upon subsequent breakage of its connecting bridges by the unscrewing process.

Furthermore, in order to reduce the screwing couple and hence the stress on the bridges, the internal teeth of the guarantee strip or strips is or are so disposed that they co-operate with the ratchet teeth on the neck by only a single internal tooth during both screwing and unscrewing. Thus, typically, when the ratchet teeth and the internal teeth are respectively uniformly spaced apart, and they are present in numbers which, when divided into one another, result in non-prime number Such an arrangement makes it possible to eject a guarantee strip of substantial circular extent, exceeding 220°, as a result of the sequential breakage of its breakable bridges when the cap is unscrewed. This sequential breakage contributes greatly to the ease of opening and terminates in the breakage of only a single last bridge upon the completion of opening, producing a marked ejection of each guarantee strip.

With caps which have a detachable guarantee strip, the strength of the ends of the ratchet teeth upon screwing and the ease of breakage of the breakable bridges during unscrewing of the cap have in the past two objectives which are often been considered irreconcilable. Applicants have realized that, in order to have in the present case a very visible and even spectacular effect of transverse ejection, it was also necessary to have bridges which are intact upon completion of screwing and easy to break upon unscrewing. Each ratchet tooth of the receptacle being elastically inclinable in the direction of screwing, the breakable bridges are preferably of minimal cross-section or particularly small rupture cross-section: 0.03 to 0.02 sq. mm and preferably 0.04 to 0.15 sq. mm without any risk of breakage during screwing.

It is not known to have this application breakable bridges of such a small cross-section.

The end of each ratchet tooth is preferably tapered at an angle of 15° to 30° over at least 0.5 mm. Preferably also, in order to reinforce its elastic return as it passes over internal relief portions during screwing-on of the cap, the base of each tooth is fixed to the shoulder of the receptacle.

These arrangements permit low level stressing of the bridges during the coarse of screwing and satisfactory locking of the cap by its guarantee strip upon completion of screwing.

Contributing to the effect of expansion of the guarantee strip upon breakage of its bridges, the cap is preferably of a fairly hard plastic material, typically of the group comprising: high density polyethylene, polypropylene, polystyrene, the copolymers of PE or PP.

The ratchet teeth of the receptacle and therefore usually its head, are typically of a less hard plastic material to increase their flexibility: for example, low density polyethylene when the cap is of high density polyethylene, or low density polyethylene or high density polyethylene when it is of polypropylene.

A particularly successful arrangement for unscrewing comprises two guarantee strips of each 160° to 180°, their free ends being respectively spaced apart by less than 3 mm. Demonstration of the first opening is surprising.

A further object of the invention is the cap itself, characterised particularly in that the breakable bridges of its guarantee strip have a minimal cross-section of between 0.03 and 0.2 sq. mm and in that it comprises at least one guarantee strip having two free ends and extending over less than 210° and preferably less than 180° in order to be able to eject itself freely the first time the cap sealing a receptacle is unscrewed. According to an alternative embodiment, each guarantee strip comprises a single reinforced breakable bridge, typically with a minimal cross-section comprised between 0.1 and 0.3 sq. mm. In this way, ejection of the strip takes place with the subsistence of a punctiform fastening to the cap, whereupon the strip can easily be detached by the consumer.

BRIEF DESCRIPTION OF THE DRAWINGS

In order that the invention may be more clearly understood, reference will now be made to the accompanying drawings, in which an embodiment of the invention is shown for purposes of illustration.

DESCRIPTION OF PREFERRED EMBODIMENT

Figure 1:
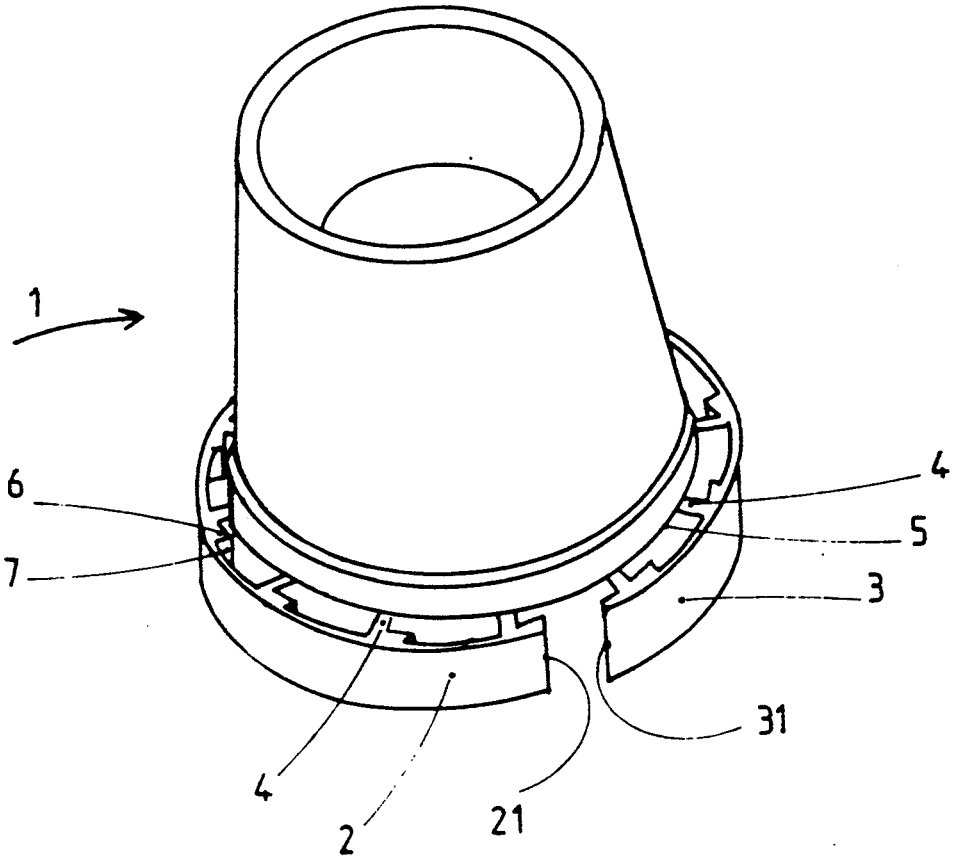
FIG. 1 shows an isometric projection of the cap according to the invention.
Figure 3:
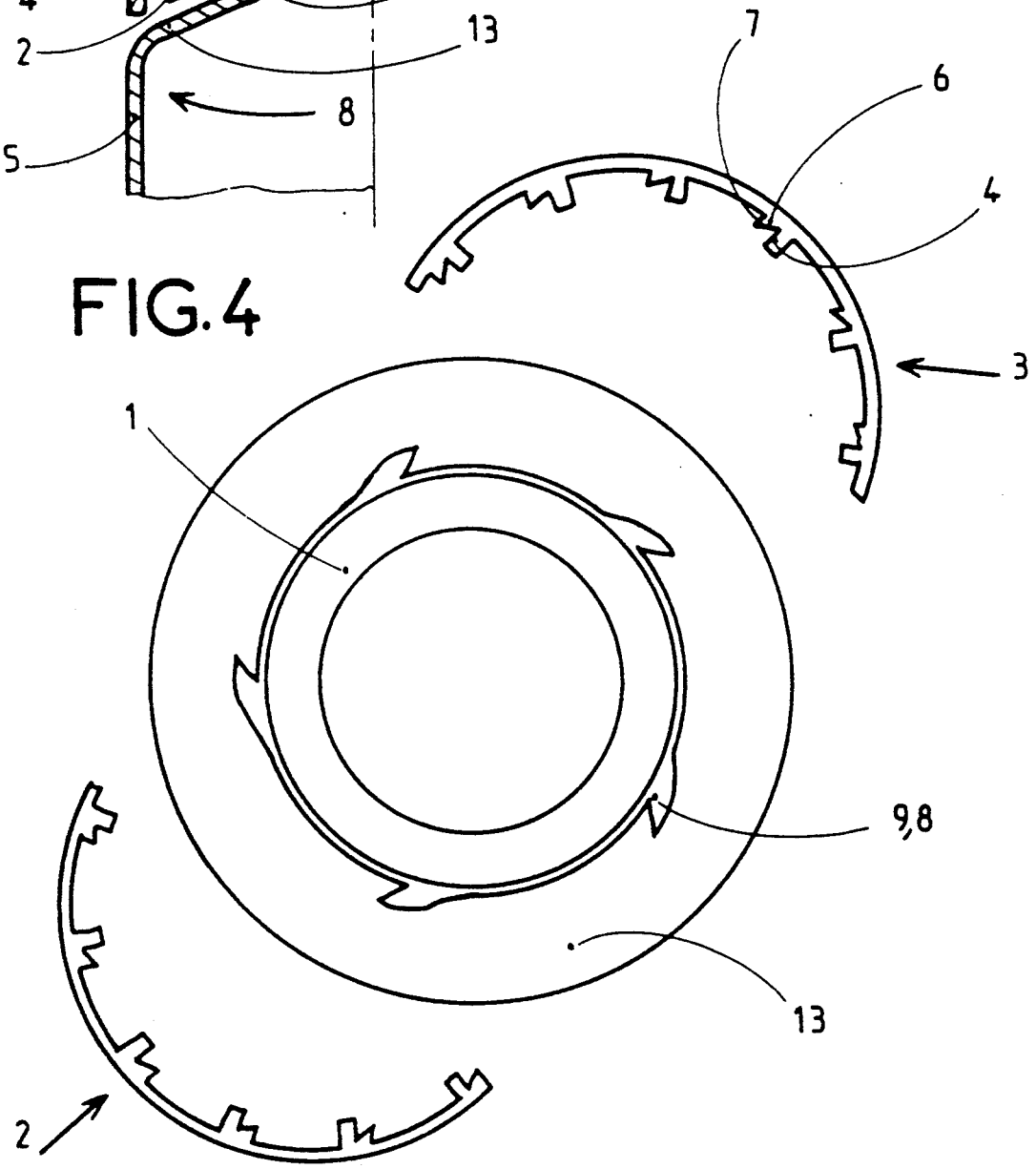
FIG. 3 is an exploded top plan view of the cap screwed onto the aforesaid tube during the course of the first unscrewing process, the guarantee strips being subsequently transversely ejected.

The cap 1 in FIG. 1 is of polypropylene (PP); it has two guarantee strips 2 and 3 of the same length and having respective ends 21 and 31 which are spaced apart by 2 mm in front of and behind the cap 1. Each guarantee strip 2 is 4 mm high and 1 mm thick and it carries on its interior surface (FIGS. 1 and 3) connecting bridges 4 which connect it to the bottom end 5 of the cap 1, each breakable point having a cross-section of $0.4\times0.3=0.12$ sq-mm at its junction with the said bottom end 5. Each strip 2 furthermore has internal teeth 6 adjacent to each bridge 4 for convenience of molding, each tooth 6 being in the form of a fin extending over the entire height of the guarantee strip 2, widening out towards the front upon unscrewing of the cap 1 and having a radial face 7 of 0.6 mm width.

In the description which follows, the spatial orientation refers to the tube or receptacle disposed with its top upwards, the cap then being arranged in the same way as it is when it is screwed onto the receptacle.

Figure 2:
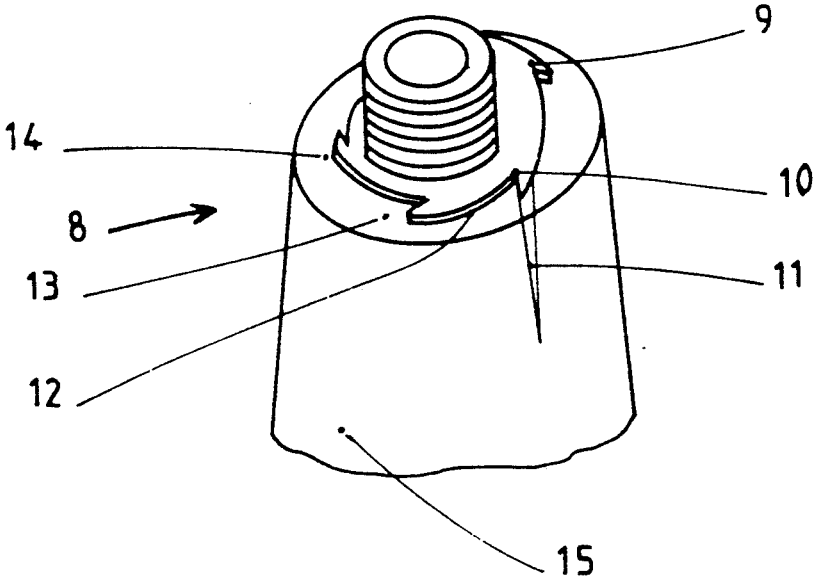
FIG. 2 shows the top of a tube associated with the cap, likewise in isometric projection.

The tube 8 (FIG. 2) comprises five teeth 9, referred to as "ratchet teeth", which are intended to oppose unscrewing of the cap 1 in that they abut the radial faces 7 of the internal teeth 6 on the guarantee strips. The stress applied to the guarantee strips 2 and 3 by these ratchet teeth 9 when the cap 1 is screwed on is rendered very low in the following way: each tooth 9, here 1 mm in length from the point 10 at which it is bent back inwardly, is made flexible by being thinned or tapered to a 20% angle 11 from the level of this return 10; furthermore, this tooth 9, which is 3 mm high has a imparts to it a flexible return which increases the closer one is to the shoulder 12, i.e., for the stresses connected with screwing on the cap 1. Moreover, by further improving the flexibility of the teeth 9 through the use of polyethylene, where the elastic return is thus assured, the head 14 of the tube 8 is over molded onto a metallo-plastic skirt 15 which has an interior coating of A1 and surface coatings of PE, while it is itself made from PE.

In the screwed arrangement obtained with this cap 1 and this tube 8, the teeth 9 having regained their original position are situated so that they abut the radial face 7 on the strip 2 or 3 over 0.4 mm, measured radially.

Tests conducted on more than ten samples have shown constant results: no breakage of the bridge 4 during screwing on in spite of their fineness, and surprising transverse ejection of the two guarantee strips 2 and 3 soon after the forcing created by the unscrewing process, the cap 1 then being only slightly unscrewed. This is the position shown in FIG. 3.

CONTROL TEST

Five caps were produced identical to the previous ones except for the use of a low density polyethylene and breakable the cross-section of the breakable bridges with a cross section of $0.8\times0.5=0.4$ sq. mm.

Screwing tests did not result in any damage to the breakable bridges. Attempts to unscrew these caps outside the invention resulted in a more difficult breakage and breakage of the guarantee strips without any transverse ejection effect.

By comparison, the foregoing tests according to the invention resulted in easy and clean breakage of the bridges with no elongation.

The order of rupture is conditioned by correspondence between the internal teeth which are of an even number and the ratchet teeth which are of an odd number: the breakable bridges being numbered from 1 to 12 in the clockwise direction, they break in the sequence 1-6-11-4-9-2-7-12-5-10-3-8. Clean breakage of the final bridge, the only one left to break, produces an ejection with a propulsion reaction and with a sharp noise. The second strip ejects similarly, offset by one bridge.

Cap with an outer trim or skirt

Figure 4:
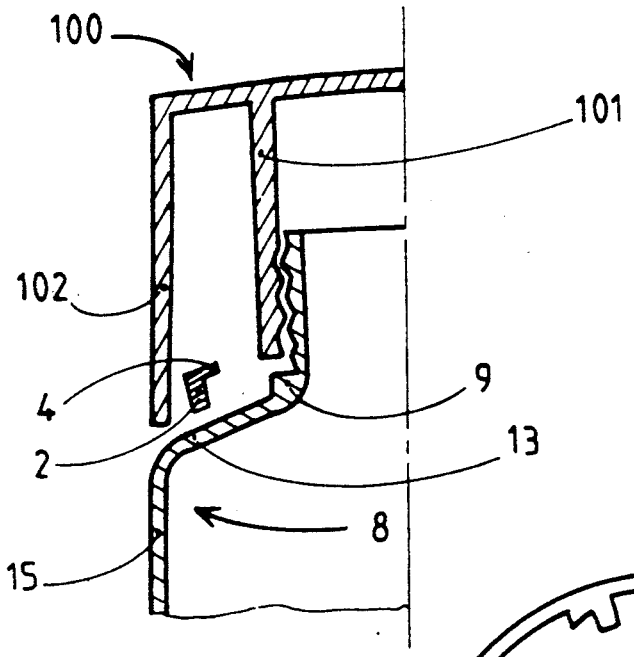
FIG. 4 shows a cap with an outer skirt screwed onto the same tube during the course of the initial unscrewing process, in semi-cross-section.

FIG. 4 shows the tube 8 and a cap 100 with an inner skirt 101 which carries at its bottom end 5 two guarantee strips identical to those of the cap 1, initially and until the first time the cap is screwed on.

The sectional plane passes through the root of a ratchet tooth 9 of the tube 8 and through the outer skirt 102, when the cap 100 is screwed on, assumes a position approx. 0.5 mm from the shoulder 13, in the elongation of the skirt 15 of the tube 8. When unscrewing commences, the guarantee strips, of which only the strip 2 is shown in the drawing, become detached and are transversely ejected. At this stage, they are held captive by the outer skirt 102 and they appear and fall when unscrewing is continued. The same behavior is apparent when the outer trim is on an over-cap.

APPLICATIONS

The cap according to the invention, associated with a receptacle having ratchet teeth with elastically inclinable ends, is used on tamper-proof receptacles in the cosmetic, pharmaceutical, hygiene, food and cleaning product industries. The head with ratchet teeth according to the invention may be fixed to the receptacle by any known means.

We claim:

1. An assembly comprising a screw closure cap (1; 100) of plastic material and a receptable (8) having a body, comprising at least one guarantee strip (2, 3) connected to said cap by breakable bridges (4), said cap (1; 100) being intended for closure of said receptacle (8), said receptacle comprising a neck provided with ratchet teeth (9), said at least one guarantee strip (2, 3) being provided with internal teeth (6) cooperating with said ratchet teeth (9) on said receptacle (8), said ratchet teeth (9) being inclinable elastically in a direction of screwing in order to allow screwing of said cap (1; 100) but preventing unscrewing of said cap without breaking at least one of said bridges (4), wherein (a) said at least one guarantee strip (2, 3) has two free ends (21) and extends peripherally of said body over a distance such that said at least one guarantee strip is ejected transversely when said cap (1; 100) is unscrewed for a first time; and (b) all of said internal teeth (6) and said ratchet teeth (9) being respectively spaced apart uniformly, and present in numbers which, when divided into one another, result in a non-prime number, so that said at least one internal teeth cooperate all together with said ratchet teeth (9) by only one internal tooth (6) at a time upon screwing and upon unscrewing, whereby said breakable bridges are broken one by one when unscrewing, and said guarantee strip having two free ends is ejected transversely when breakage is completed.

2. An assembly according to claim 1, wherein said breakable bridges (4) of said cap (1; 100) have a minimal cross-section comprised between 0.03 and 0.2 sq.-mm.

3. An assembly according to claim 2, wherein said ratchet teeth (9) have ends tapered over at least 0.5 mm to an angle of 10° to 30°.

4. An assembly according to claim 3, wherein said ratchet teeth (9) have a base (12) fixed on a shoulder (13) of said receptacle (8) in such a way that said teeth have an elastic return which increases with proximity to said shoulder (13).

5. An assembly according to claim 1 or 2, wherein said cap (1; 100) is of a plastic material selected from the group consisting of high density polyethylene, polypropylene, polystyrene, copolymers of PE and PP.

6. An assembly according to claim 5, wherein said ratchet teeth (9) are of a plastic material less hard that said plastic

7. An assembly according to any one of claims 2, 3 and 1, wherein said at least one guarantee strip comprises two guarantee strips (2, 3) having free ends (21, 31) which are respectively opposite and which are spaced apart from each other by less than 3 mm, each strip (2, 3) extending over 160° to 180°.

8. An assembly according to any one of claims 2, 3 and 29, wherein said at least one guarantee strip comprises a single reinforced breakable bridge which can be broken after ejection of said strip.

9. A screw closure cap of plastic material (1, 100) for closure of a receptacle (8) carrying ratchet teeth (9), said closure cap comprising a body (5) and at least one guarantee strip (2, 3) connected to said body (5) by breakable bridges (4), said at least one guarantee strip (2, 3) carrying internal teeth (6) adapted to cooperate with said ratchet teeth (9) of said receptacle (8), said breakable bridges (4) having a minimal cross-section comprised between 0.03 and 0.2 sq.-mm, and said at least one guarantee strip (2) having two free ends (21) and extending circularly over less than 210°, an enclosing skirt (102) being provided outside said body (101) and said at least one guarantee strip (2), for provisionally retaining said at least one guarantee strip (2, 3) upon its ejection at the onset of screwing.

10. A closure cap (1, 100) according to claim 9, wherein said at least one guarantee strip comprises two guarantee strips (2, 3) having free ends (21, 31) which are respectively opposite and which are spaced apart by less than 3 mm, each guarantee strip (2, 3) extending over 160° to 180°.

11. A cap according to claim 9, wherein said at least one guarantee strip comprises a single reinforced breakable bridge.

12. A cap according to claim 11, wherein said single reinforced breakable bridge has a minimal cross-section comprised between 0.1 and 0.3 sq.-mm, each other breakable bridge having a cross-section comprised between 0.04 and 0.15 sq.-mm.

* * * * *

UNITED STATES PATENT AND TRADEMARK OFFICE

CERTIFICATE OF CORRECTION

PATENT NO. : 5,318,192

DATED : June 7, 1994

INVENTOR(S) : Rebeyrolle et al

It is certified that error appears in the above-identified patent and that said Letters Patent is hereby corrected as shown below:

In column 6, claim 8, line 4, change "29" to --1--.

Signed and Sealed this

Twenty-seventh Day of December, 1994

*Attest:*

Bruce Lehman

BRUCE LEHMAN

*Attesting Officer*

*Commissioner of Patents and Trademarks*